US009932784B2

(12) United States Patent
Wang et al.

(10) Patent No.: US 9,932,784 B2
(45) Date of Patent: Apr. 3, 2018

(54) DEVICE FOR HANDLING OIL PIPES AND METHOD FOR WORKOVER

(71) Applicants: China Petroleum & Chemical Corporation, Beijing (CN); Research Institute of Petroleum Engineering, Shengli Oil Field, SINOPEC, Dongying, Shandong Province (CN)

(72) Inventors: Zenglin Wang, Dongying (CN); Guangqi Gao, Dongying (CN); Lei Zhang, Dongying (CN); Zeng Fu, Dongying (CN); Huihui Song, Dongying (CN); Qingsheng Jia, Dongying (CN); Bin Wei, Dongying (CN); Qingong Zhi, Dongying (CN); Qianwen Tang, Dongying (CN); Qiuhan Su, Dongying (CN); Fangyuan Zhang, Dongying (CN); Liwei Hao, Dongying (CN)

(73) Assignees: CHINA PETROLEUM & CHEMICAL CORPORATION, Beijing (CN); RESEARCH INSTITUTE OF PETROLEUM ENGINEERING, SHENGLI OIL FIELD, SINOPEC, Dongying (CN)

( * ) Notice: Subject to any disclaimer, the term of this patent is extended or adjusted under 35 U.S.C. 154(b) by 0 days.

(21) Appl. No.: 15/080,139

(22) Filed: Mar. 24, 2016

(65) Prior Publication Data

US 2016/0281445 A1 Sep. 29, 2016

(30) Foreign Application Priority Data

Mar. 27, 2015 (CN) ..... 2015 1 0142159

(51) Int. Cl.
*B65G 57/10* (2006.01)
*E21B 19/15* (2006.01)

(52) U.S. Cl.
CPC ..... *E21B 19/15* (2013.01)

(58) Field of Classification Search
CPC ..... B65G 57/10; B65G 57/186; B65G 59/04; B65G 59/103; B65G 2814/031
(Continued)

(56) References Cited

U.S. PATENT DOCUMENTS 3,601,263 A * 8/1971 Stratton ..... B21B 39/002 164/412
4,600,358 A * 7/1986 Graf ..... B23Q 5/385 414/751.1
(Continued)

FOREIGN PATENT DOCUMENTS

CN 1920239 A 2/2007
CN 103485735 A 1/2014

*Primary Examiner* — Joseph Dillon, Jr.
(74) *Attorney, Agent, or Firm* — Buchanan Ingersoll & Rooney PC

(57) ABSTRACT

A device for handling oil pipes and a method for workover includes a base, which includes an oil pipe bearing area extending in a longitudinal direction, the oil pipe bearing area being provided therein with at least one positioning member arranged in a transverse direction perpendicular to the longitudinal direction of the base, for positioning an oil pipe; and a movable oil pipe grasping assembly, which is located above the base and configured to grasp the oil pipe and place the oil pipe in the oil pipe bearing area, or grasp the oil pipe from the oil pipe bearing area and place the oil pipe in an area outside the oil pipe bearing area. The device for handling oil pipes provided by the present disclosure is able to achieve automatic handling of oil pipes, thereby decreasing labor intensity of operators, and improving working efficiency and safety factors of the work.

19 Claims, 8 Drawing Sheets

(58) Field of Classification Search
USPC ..... 414/22.62, 226.02, 751.1, 752.1, 753.1, 414/910
See application file for complete search history.

(56) References Cited

U.S. PATENT DOCUMENTS 4,815,922 A * 3/1989 Midorikawa ..... B41F 13/0016 211/60.1
5,265,999 A * 11/1993 Wenschhof ..... B65H 19/126 242/559.1
5,605,432 A * 2/1997 Fink ..... B25J 15/04 414/752.1
5,674,049 A * 10/1997 Pienta ..... B65G 47/252 414/390
5,738,484 A * 4/1998 Taylor ..... B65G 61/00 294/67.2
6,059,520 A * 5/2000 Adams ..... B21C 47/242 414/800
6,174,125 B1 * 1/2001 Davis ..... B66F 9/185 294/93
6,374,928 B1 * 4/2002 Teller ..... E21B 19/15 175/52
8,845,260 B2 * 9/2014 Gerber ..... E21B 19/15 414/22.54
2006/0182614 A1 * 8/2006 Roesch ..... B65B 17/02 414/793
2007/0154297 A1 * 7/2007 Huang ..... B65G 47/91 414/752.1
2009/0148266 A1 * 6/2009 Baumann ..... B65G 59/023 414/796.2
2012/0118639 A1 * 5/2012 Gerber ..... E21B 19/15 175/52
2012/0130537 A1 * 5/2012 Gerber ..... E21B 19/15 700/244
2013/0108408 A1 * 5/2013 Saison ..... B65H 3/0816 414/797
2013/0336748 A1 * 12/2013 Hilton ..... E21B 19/155 414/22.62
2014/0023461 A1 * 1/2014 Schaller ..... H01L 21/67742 414/222.07
2017/0137236 A1 * 5/2017 Sonoura ..... B65G 59/02

* cited by examiner

DEVICE FOR HANDLING OIL PIPES AND METHOD FOR WORKOVER

CROSS-REFERENCE TO RELATED APPLICATIONS

The present application claims the priority of Chinese patent application CN201510142159.1, entitled "Device and method for automatic handling of oil pipes" and filed on Mar. 27, 2015, the entirety of which is incorporated herein by reference.

TECHNICAL FIELD

The present disclosure relates to the technical field of oil-gas field development, and in particular, to a device for handling oil pipes. The present disclosure further relates to a method for workover using said device for handling oil pipes.

TECHNICAL BACKGROUND

When an oil-water well in an oil field does not work properly, oil pipes disposed therein are usually pulled out so that workover can be performed. Currently, before the oil pipes are pulled out, some arrangements have to be made at a well site for stacking of oil pipes. For example, it is necessary to set up a base for stacking the oil pipes. In the process of pulling out the oil pipes, a large amount of manual labor is required to stack the oil pipes horizontally. For instance, after the oil pipes are pulled out, operators have to carry, roll, or pull the oil pipes so as to stack them horizontally. This working mode requires large numbers of operators and is highly labor intensive. Besides, it can result in low work efficiency and frequent damages to operators.

Chinese patent application CN103485735A discloses an automatic oil pipe handling box, which is a vertical-type device for handling oil pipes. Chinese patent application CN1920239 also discloses a vertical-type device for handling oil pipes. platform, and is not suitable for horizontal stacking of oil pipes.

SUMMARY OF THE INVENTION

Directed against the above problem, the present disclosure provides a device for handling oil pipes which is able to achieve automatic handling of oil pipes, thereby decreasing labor intensity of operators, and improving working efficiency and safety factors of work.

The present disclosure, at one aspect, provides a device for handling oil pipes. The device comprises a base and a movable oil pipe grasping assembly. The base comprises an oil pipe bearing area extending in a longitudinal direction. The oil pipe bearing area is provided therein with at least one positioning member arranged in a spaced-apart manner and in a transverse direction perpendicular to the longitudinal direction of the base, for positioning an oil pipe. The oil pipe grasping assembly is located above the base and configured to grasp the oil pipe and place the oil pipe in the oil pipe bearing area, or grasp the oil pipe from the oil pipe bearing area and place the oil pipe in an area outside the oil pipe bearing area.

According to the present disclosure, the device comprises the base for stacking the oil pipes, which can simplify arrangements at a well site. Besides, the stacking of the oil pipes can be completed by simply using the oil pipe grasping assembly, thus avoiding manual operations on the oil pipes, thereby decreasing labor intensity of operators, and improving working efficiency and safety factors of the work. In addition, the positioning member can support the oil pipe and prevent the oil pipe from rolling off, which may further increase safety factors of the work.

In one embodiment, the base further comprises a positioning member holding area adjacent to an end of the oil pipe bearing area. The positioning member holding area contains a plurality of positioning members which are operable to be arranged in the oil pipe bearing area for stacking multiple layers of oil pipes.

In one embodiment, the base further comprises an oil pipe delivering assembly arranged on a lateral side of the base and parallel to the oil pipe bearing area. The device for handling oil pipes is configured as such that the oil pipe is first placed longitudinally in the oil pipe delivering assembly and then placed, by the oil pipe grasping assembly, in the oil pipe bearing area, or, that the oil pipe is grasped from the oil pipe bearing area and placed longitudinally in the oil pipe delivering assembly by the oil pipe grasping assembly. By providing the oil pipe delivering assembly, the oil pipe is grasped by the oil pipe grasping assembly in a manner parallel to the oil pipe bearing area. In this way, the oil pipe is lowered, thus increasing safety factors of the work.

In one embodiment, the oil pipe delivering assembly comprises a groove slideway arranged fixedly on the base in the longitudinal direction. The groove slideway is provided therein with an oil pipe pulley which is configured as such that an free end of the oil pipe in a vertical state can be accommodated in the oil pipe pulley and the oil pipe pulley can slide along the groove slideway under the drive of the oil pipe pulley until the oil pipe is contained longitudinally in the groove slideway. In such a structure, there is no relative slide between the free end of the oil pipe and the oil pipe pulley, which can prevent damage to thread of the free end of the oil pipe. In addition, the oil pipe pulley is capable of enabling the oil pipe to steadily enter into a horizontal state from the vertical state, which may further increase safety factors of the work.

In one embodiment, the oil pipe delivering assembly further comprises a support seat for holding the groove slideway on the base, and an oil pipe carrying mechanism arranged longitudinally between the groove slideway and the oil pipe bearing area. The oil pipe carrying mechanism is arranged lower than the groove slideway. The groove slideway is provided with a thrust mechanism on a bottom surface thereof. The thrust mechanism is connected to a driving member secured on the support seat, so that the groove slideway can be overturned to cause the oil pipe to enter into the oil pipe carrying mechanism.

In one embodiment, the groove slideway is provided with a plurality of guide arms on a side wall thereof adjacent to the oil pipe carrying mechanism. The plurality of guide arms extends along a direction of the side wall. With such a structure, when the oil pipe rolls out of the groove slideway into the oil pipe carrying mechanism, the guide arms will guide the oil pipe, thereby achieving a steady movement of the oil pipe. Moreover, in the procedure of taking the oil pipe out of the oil pipe bearing area, the guide arms can take the oil pipe out of the oil pipe carrying mechanism and enable the oil pipe to be contained automatically in the groove slideway, thus simplifying the work.

In one embodiment, the thrust mechanism comprises a thrust board with a first end connected fixedly to the bottom surface of the groove slideway and a second end connected to a rotary output shaft of a driving member.

In one embodiment, the thrust mechanism comprises a thrust board, and a rotary shaft movably penetrating a central area of the thrust board. The thrust board is connected fixedly to the bottom surface of the groove slideway at a first end thereof, and connected to a reciprocating output shaft of a driving member at a second end thereof. The rotary shaft is secured on the support seat.

In one embodiment, the oil pipe carrying mechanism comprises a plurality of longitudinally arranged spaced-apart carrying brackets, and support boards arranged between neighboring carrying brackets.

In one embodiment, a first oil pipe rail for the oil pipe grasping assembly is provided above the base. The first oil pipe rail is configured to extend in the longitudinal direction to run across the oil pipe bearing area and the positioning member holding area, and connect the base through a frame. The oil pipe bearing area and the oil pipe carrying mechanism are located inside the frame, and the groove slideway is located outside the frame. Since the groove slideway is located outside the frame, when the oil pipe is placed into the groove slideway, the oil pipe will not be blocked by the frame, which facilitates the operation. In addition, since the oil pipe bearing area is located inside the frame, the stacked oil pipes will be protected by the frame from falling off, which may further increase safety factors of the work.

In one embodiment, the first oil pipe rail comprises two spaced-apart parallel rail bars. The oil pipe grasping assembly comprises two spaced-apart transverse members movably connected between the two rail bars, a bearing board movably connected between the two transverse members, a vertically movable rod penetrating the bearing board vertically, a connecting rod arranged at a lower end of the vertically movable rod, and a clamp arranged at a lower end of the connecting rod and rotatable in a horizontal plane. With such a structure, the oil pipe grasping assembly can not only grasp the positioning member from the positioning member holding area, but also grasp the oil pipe from the oil pipe delivering assembly, which may greatly facilitate the use of the device for handling oil pipes and simplify the structure thereof.

Preferably, the oil pipe grasping assembly further comprises an anti-rotation board secured at the lower end of the vertically movable rod, and an anti-rotation rod which is parallel to the vertically movable rod and movably penetrates the bearing board. The anti-rotation rod is connected fixedly to the anti-rotation board at a lower end thereof. The connecting rod is rotatably connected to the anti-rotation board at an upper end thereof. The anti-rotation board is provided thereon with a driving member for driving the connecting rod into rotation so as to cause the clamp to rotate in the horizontal plane. The arrangement of the anti-rotation board and the anti-rotation rod enables the vertically movable rod to move only in a vertical direction but not to rotate in a horizontal direction. Therefore, when the oil pipe is grasped by the clamp, the oil pipe can only move in the vertical direction but cannot rotate in the horizontal direction, which may greatly increase safety factors of the work.

In one embodiment, the device further comprises a second oil pipe rail arranged above the base for the oil pipe grasping assembly. The second oil pipe rail is configured to extend in the transverse direction to run across the oil pipe bearing area and reach to the oil pipe delivering assembly, and connect the base through a frame. In this manner, the oil pipe grasping assembly can move along the second oil pipe rail to the oil pipe delivering assembly to grasp the oil pipe, and then move along the second oil pipe rail to the oil pipe bearing area to place the oil pipe in the oil pipe bearing area.

In one embodiment, the device further comprises a positioning member grasping assembly arranged above the base. The positioning member grasping assembly is configured to grasp the positioning member from the positioning member holding area and place the positioning member in the oil pipe bearing area, or grasp the positioning member from the oil pipe bearing area and place the positioning member in the positioning member holding area. Preferably, the base comprises two positioning member holding areas which are adjacent to the ends of the oil pipe bearing area respectively. The device for handling oil pipes comprises a positioning member rail arranged above the base for the positioning member grasping assembly. The positioning member rail comprises a first section of the positioning member rail and a second section of the positioning member rails which are configured to extend in the longitudinal direction to run across a corresponding positioning member holding area, and are connected to two sides of the second oil pipe rail respectively. The positioning member rail is connected to the base through a frame. Two positioning member grasping assemblies for two positioning member holding areas respectively are arranged in the first section of the positioning member rail and the second section of the positioning member rail respectively.

In one embodiment, the oil pipe grasping assembly or the positioning member grasping assembly comprises a bearing board movable along a rail, a vertically movable rod penetrating the bearing board vertically, and a clamp secured at a lower end of the vertically movable rod. Preferably, the oil pipe grasping assembly further comprises an anti-rotation rod parallel to the vertically movable rod and movably penetrating the bearing board, the anti-rotation rod being connected fixedly to the clamp at a lower end thereof. By providing the anti-rotation rod, the vertically movable rod can move only in a vertical direction but not rotate. Therefore, when the oil pipe is grasped by the clamp, the oil pipe can only move in the vertical direction but cannot rotate, which may greatly increase safety factors of the work.

In one embodiment, the vertically movable rod is a threaded rod, and an internally threaded member associated with the threaded rod is provided on the bearing board.

In one embodiment, the device further comprises a measuring assembly for measuring length of the oil pipe. The measuring assembly includes two clamping members for clamping two ends of the oil pipe, and a length measuring instrument arranged on either of the two clamping members.

In one embodiment, the measuring assembly further comprises a clamping member guide rail longitudinally arranged below the plurality of carrying brackets. One of the two clamping members is fixedly arranged, and the other is movable along the clamping member guide rail under the drive of a driving member. For example, one of the clamping members can be arranged at a longitudinal end of the base, and the clamping member guide rail extends to another longitudinal end of the base. In this way, it can be ensured that the two clamping members can clamp the two ends of the oil pipe, and that in the meanwhile, only one of the two clamping members is movable, thus facilitating the use of the device.

In one embodiment, the positioning member comprises a long and narrow body, a plurality of grooves formed on an upper surface of the body for positioning the oil pipe therein, and a connecting structure formed at both ends of the body. Preferably, the connecting structure comprises a receiving groove with an upward opening, and a bolt extending downwards. The bolt has an extending length larger than a depth of the receiving groove.

In one embodiment, the oil pipe bearing area is provided therein with a plurality of spaced-apart sockets which are arranged in multiple lines along the longitudinal direction, and the positioning member comprises a plurality of straight rods each vertically insertable into a respective one of the plurality of sockets.

The present disclosure, in another aspect, provides a method for workover. The method comprises the following steps. In step 1, an oil pipe pulled out of a well is stored using the above device for handling oil pipes. In step 2, workover is performed. In step 3, the oil pipe is taken out of the device for handling oil pipes and run into the well. The device for handling oil pipes has a base which comprises an oil pipe bearing area extending in a longitudinal direction, an oil pipe grasping assembly, and an oil pipe delivering assembly arranged on a lateral side of the base and parallel to the oil pipe bearing area. In step 1, the vertically slung oil pipe is placed first in the oil pipe delivering assembly, and then placed in the oil pipe bearing area by the oil pipe grasping assembly. In step 3, the oil pipe is grasped from the oil pipe bearing area and placed in the oil pipe delivering assembly by the oil pipe grasping assembly, and then hoisted to a vertical state and run into the well.

In one embodiment, the device for handling oil pipes further comprises a measuring assembly for measuring length of the oil pipe. In step 3, after the length of the oil pipe is measured by the measuring assembly, the oil pipe is run into the well.

Compared with existing technologies, the present disclosure achieves the following beneficial effects. A) The device for handling oil pipes comprises the base for stacking the oil pipes, which may simplify arrangements at a well site. B) The stacking of the oil pipes can be completed by simply using the oil pipe grasping assembly, thus avoiding manual operations on the oil pipes, thereby decreasing labor intensity of operators, and improving working efficiency and safety factors of the work. C) The positioning member is capable of supporting the oil pipes and preventing the oil pipes from rolling off, which may further increase safety factors of the work.

BRIEF DESCRIPTION OF THE DRAWINGS

The present disclosure will be described further in detail below based on the embodiments and with reference to the accompanying drawings.

FIGS. 8*a* and 8*b* schematically show the structure of a positioning member in its first embodiment according to the present disclosure;

In the accompanying drawings, same components are indicated using same reference signs. The drawings are not drawn to scale.

DETAILED DESCRIPTION OF THE EMBODIMENTS

The present disclosure will be explained in detail with reference to the accompanying drawings.

With reference to the Specification, Abstract, and Claims herein, it should be noted that the singular forms "a", "an", "the", and the like include plural referents unless expressly discussed otherwise.

Figure 1:
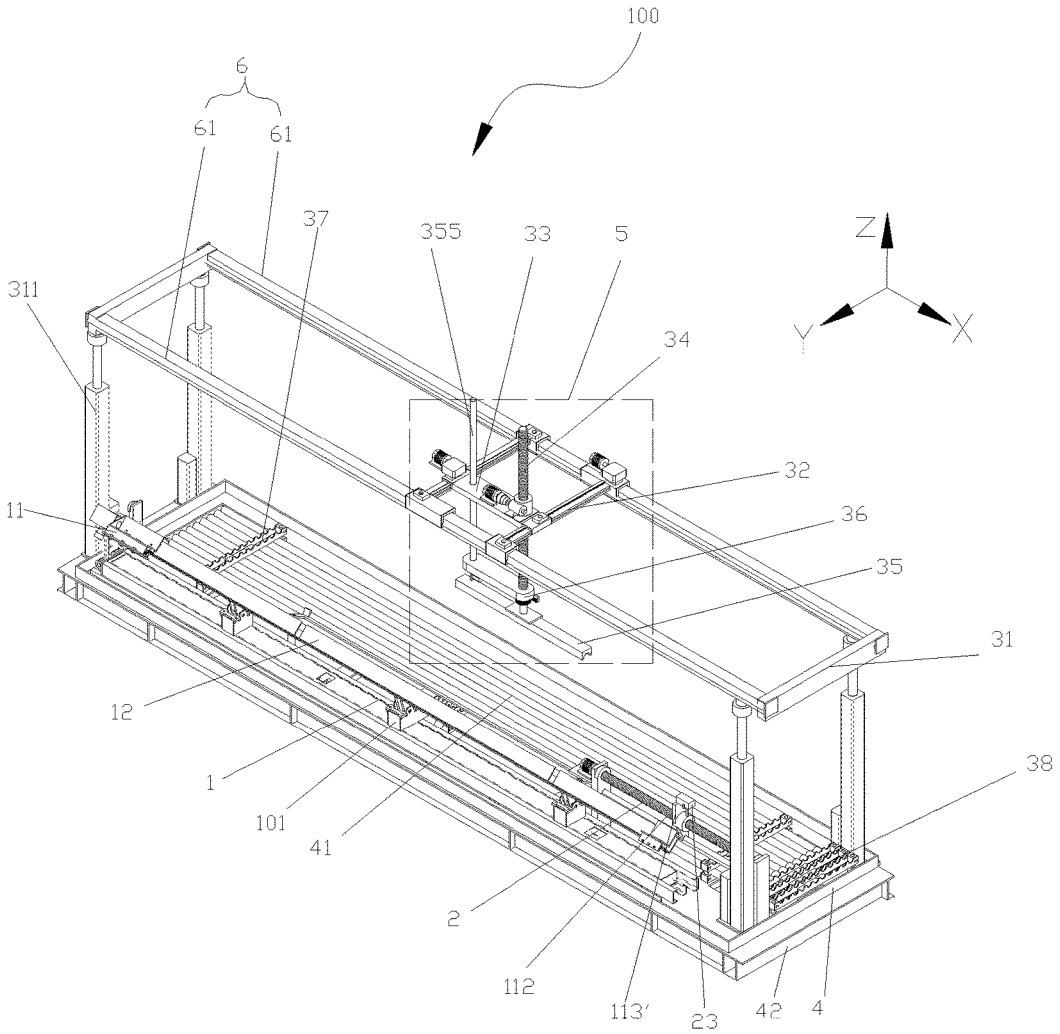
FIG. 1 schematically shows the structure of a device for handling oil pipes according to a first embodiment of the present disclosure.
Figure 2:
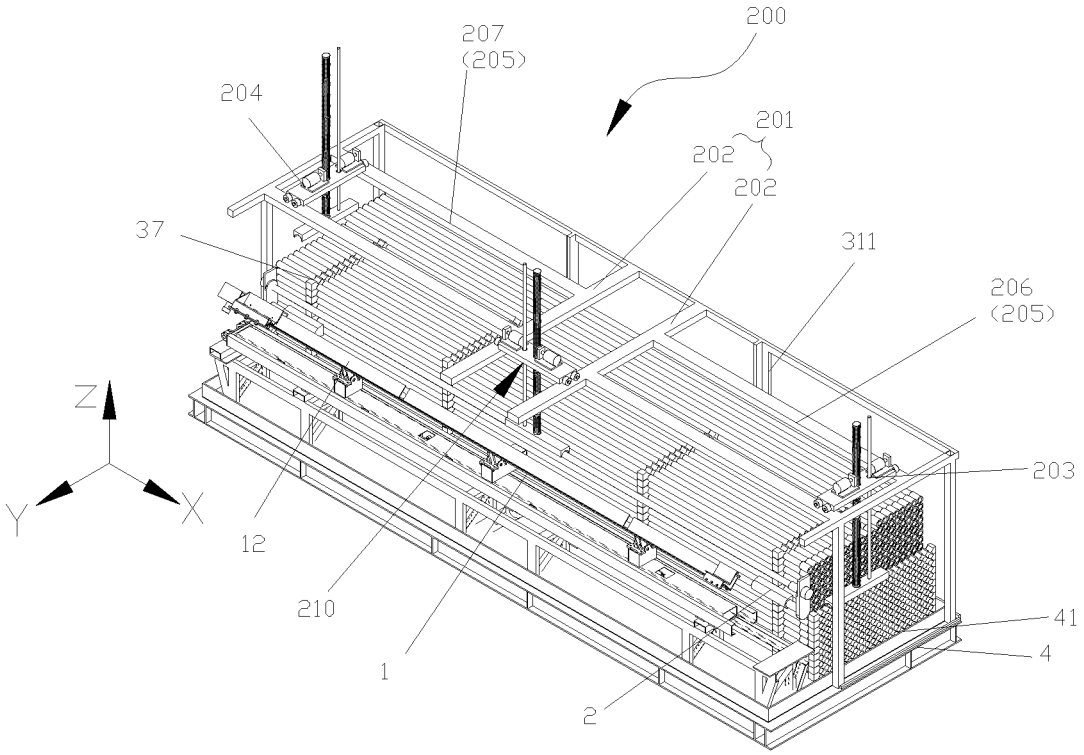
FIG. 2 schematically shows the structure of a device for handling oil pipes according to a second embodiment of the present disclosure.
Figure 3:
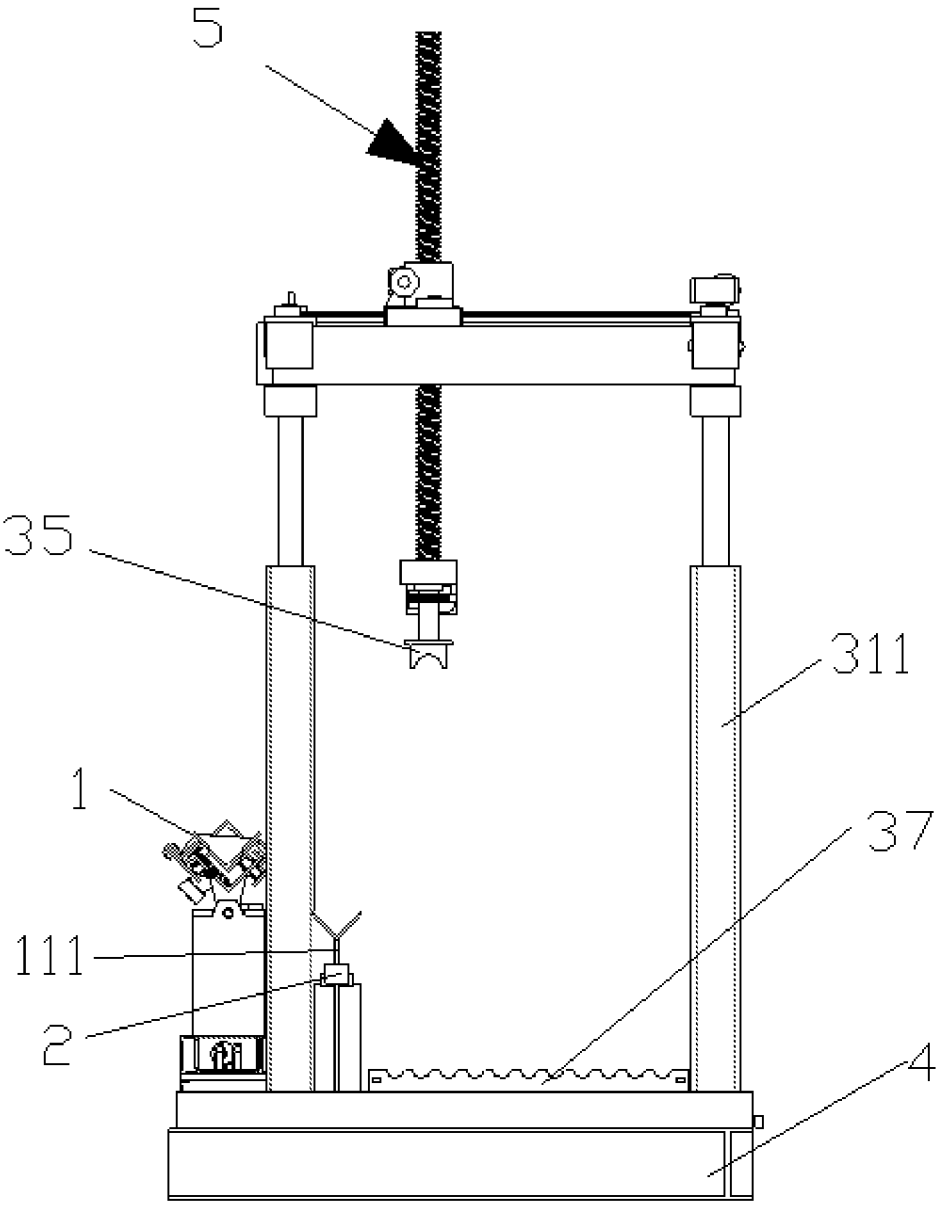
FIG. 3 shows a side view of the device for handling oil pipes according to the first embodiment of the present disclosure.
Figure 4:
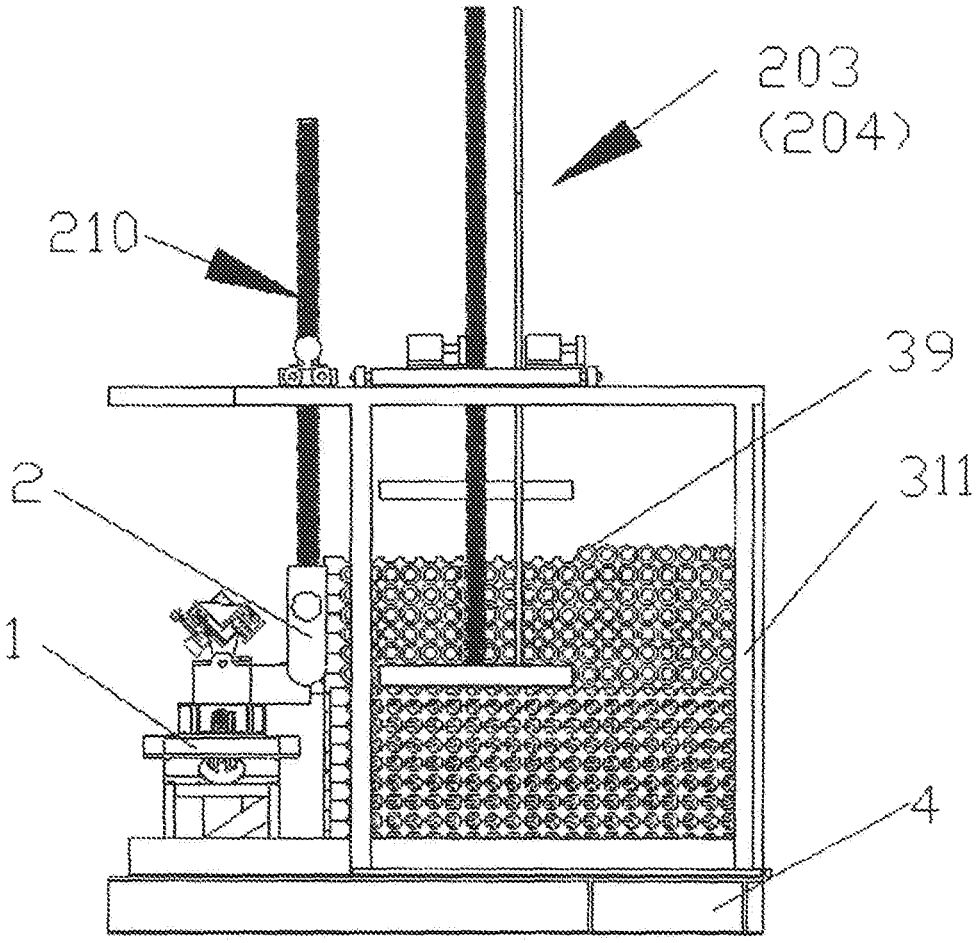
FIG. 4 shows a side view of the device for handling oil pipes according to the second embodiment of the present disclosure.

FIG. 1 shows a first embodiment of a device 100 for handling oil pipes according to the present disclosure. For ease of illustrating the technical solutions of the present disclosure, in the coordinate systems as shown in FIGS. 1 and 2, the direction of the x-axis is referred to as a longitudinal direction, the direction of the y-axis is referred to as a transverse direction, and the direction of the z-axis is referred to as a vertical direction.

As shown in FIG. 1, the device 100 for handling oil pipes comprises a base 4 and an oil pipe grasping assembly 5 arranged above the base 4. An oil pipe bearing area 41 extending in a longitudinal direction is formed on the base 4. The oil pipe bearing area 41 is provided therein with positioning members 37 arranged in a transverse direction. The positioning members 37 can divide the oil pipe bearing area 41 into a plurality of sub-areas in the longitudinal direction, in which oil pipes can be disposed. The oil pipe grasping assembly 5 is movable above the base 4 so as to grasp the oil pipe and place the oil pipe in the oil pipe bearing area 41 (or in the sub-area), or grasp the oil pipe from the oil pipe bearing area 41 (or from the sub-area) and place the oil pipe in an area outside the oil pipe bearing area 41. The base 4 may further comprise a waste liquid collecting pool 42 for collecting oil fouling from the oil pipe, thus avoiding pollution of a well site and even enabling an impervious film at the well site unnecessary.

Figure 8B:
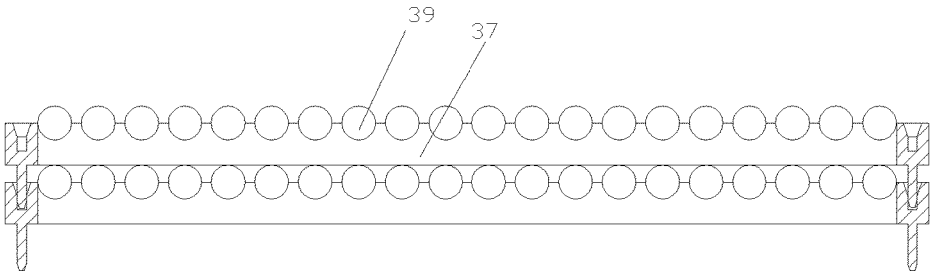

The positioning member 37 can have various forms. FIGS. 8*a* and 8*b* show the first embodiment of the positioning member 37. As shown in FIG. 8*a*, the positioning member 37 is generally in the form of a long strip, and has a long and narrow body 372 and a connecting structure 373 arranged at both ends of the body. A plurality of grooves 371 are formed on an upper surface of the body 372, for positioning the oil pipe 39 therein. Preferably, only two spaced-apart positioning members 37 are arranged in the oil pipe bearing area 41, and a flat board 13 (see FIG. 10) having no grooves 371 is provided between the two positioning members 37. The flat board 13 is used only for bearing weight of the oil pipe, not for positioning the oil pipe. In this manner, it will be easier to place the oil pipe on the positioning members 37.

The connecting structure 373 comprises a receiving groove 375 with an upward opening, and a bolt 374 extending downwards. The oil pipe bearing area 41 is provided thereon with a socket (not shown in the Figs.) for receiving the bolt 374, so that the positioning member 37 can be firmly arranged in the oil pipe bearing area 41. Besides, by means of the bolt 374 and the receiving groove 375, a plurality of positioning members 37 can be stacked layer by layer (as shown in FIG. 8*b*). In this manner, the oil pipes can be placed on each layer of the positioning member 37, and the device 100 will be capable of holding many oil pipes 39. It should be understood that in this case, a gap between two neighboring layers of the positioning member 37 should be larger than or equal to a diameter of the oil pipe 39, which can be achieved by enabling the bolt 374 to have an extending length L1 larger that a depth L2 of the receiving groove 375.

To make it easier to take and place the plurality of positioning members 37, a positioning member holding area 38 is arranged on the base 4. The positioning member holding area 38 may be provided, for example, on an area adjacent to a longitudinal end of the oil pipe bearing area 41. In this case, the oil pipe grasping assembly 5 will be able to grasp the positioning member 37 from the positioning member holding area 38 and place the positioning member 37 in the oil pipe bearing area 41.

Figure 9:
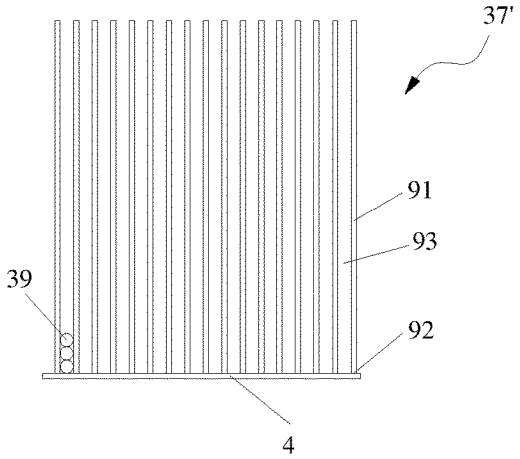
FIG. 9 schematically shows the structure of a positioning member in its second embodiment according to the present disclosure.

FIG. 9 shows a second embodiment of the positioning member 37'. In the embodiment as shown in FIG. 9, the oil pipe bearing area 41 is provided therein with a plurality of spaced-apart sockets 92, each of which is provided with a straight rod 91 inserted therein. These straight rods 91 are arranged in multiple lines along the longitudinal direction to form the positioning members 37'. In operation, a plurality of oil pipes 39 can be stacked in a gap 93 between two neighboring lines of the straight rods 39.

It should be understood that, in the embodiment as shown in FIG. 9, it is not necessary to provide a positioning member holding area on the base 4, but the straight rods 91 are inserted beforehand into the respective sockets 92 in the oil pipe bearing area 41. Certainly, to facilitate removal and carry of the straight rods 91, the base 4 can be provided thereon with a positioning member holding area.

The base 4 is further provided with an oil pipe delivering assembly 1 on a lateral side thereof. Specifically, the oil pipe delivering assembly 1 comprises a groove slideway 12 longitudinally arranged on the base 4, and an oil pipe pulley 11 associated with the groove slideway 12. The groove slideway 12 is also longitudinally arranged. That is, the groove slideway 12 is parallel to the oil pipe bearing area 41. Under the drive of an external force, the oil pipe pulley 11 can slide along the groove slideway 12. With such a structure, in operation, a free end of the oil pipe in a vertical state is first accommodated in the oil pipe pulley 11, and then moves, together with the oil pipe pulley 11, along the groove slideway 12, by means of which the oil pipe will enter into a longitudinal state gradually from the vertical state, and finally contained in the groove slideway 12. Then the oil pipe grasping assembly 5 will be able to easily transfer the oil pipe in the longitudinal state to the oil pipe bearing area 41. Of course, the oil pipe grasping assembly 5 is also able to easily transfer the oil pipe from the oil pipe bearing area 41 to the groove slideway 12. It should be noted that, in order to save cost, in the case that the groove slideway 12 can safely contain the oil pipe, the groove slideway 12 can be constructed to have a length smaller than the oil pipe.

Figure 5:
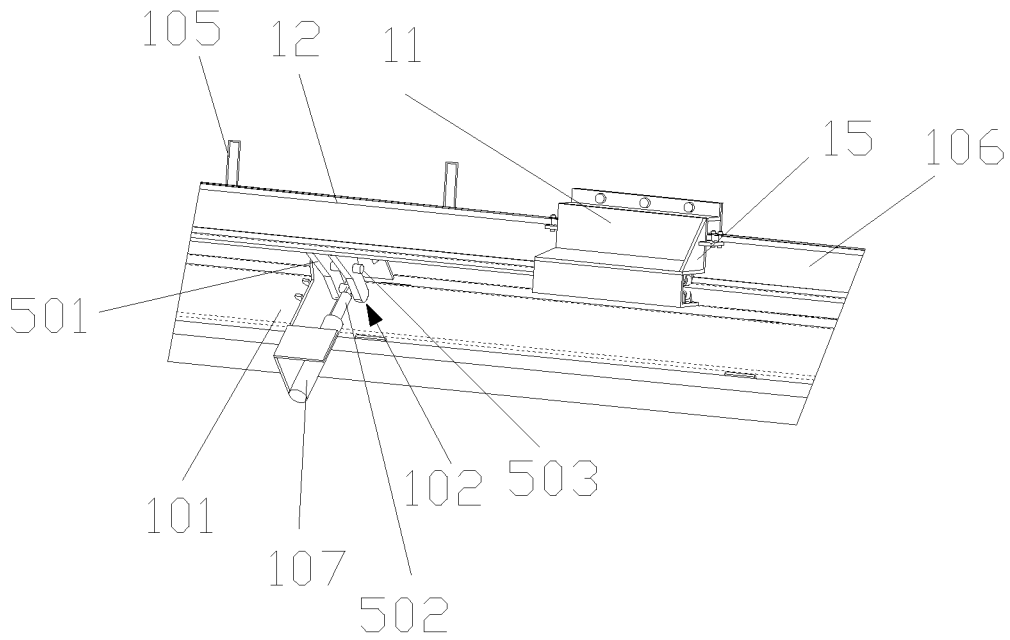
FIG. 5 schematically shows the structure of an oil pipe pulley and a thrust mechanism in their first embodiments according to the present disclosure.

The groove slideway 12 can have differently shaped cross-sections. FIG. 5 schematically shows a groove slideway 12 having a roughly V-shaped cross-section and an oil pipe pulley 11 having a roughly V-shaped cross-section. The oil pipe pulley 11 is provided with a stop 15 at an end thereof. The stop 15 is able to prevent the free end of the oil pipe from sliding off the oil pipe pulley 11 in operation, whereby the oil pipe can be accommodated in the oil pipe pulley 11.

The groove slideway 12 is provided with a plurality of spaced-apart guide arms 105 on a side wall 106 thereof. The plurality of guide arms 105 extends along a direction of the side wall 106, and is used for guiding the movement of the oil pipe, which will be explained below.

Now return to FIG. 1. In order to achieve the movement of the oil pipe grasping assembly 5, a first oil pipe rail 6 extending in the longitudinal direction is provided above the base 4 for the oil pipe grasping assembly 5. The first oil pipe rail 6 comprises two spaced-apart parallel rail bars 61, which are configured to extend in the longitudinal direction to run across the oil pipe bearing area 41 and the positioning member holding area 38, and connect the base 4 through vertical frames 311. To make the first oil pipe rail 6 more stable, the two rail bars 61 are connected to each other through two tiepieces 31 extending in the transverse direction. Seen as a whole, the first oil pipe rail 6, the tiepieces 31, and the frames 311 together form a cuboid, and the oil pipe grasping assembly 5 is located at the top of the cuboid. In a preferred embodiment, the frames 311 can be extended or contracted vertically, so that the base 4 can contain more or less oil pipes.

Figure 7:
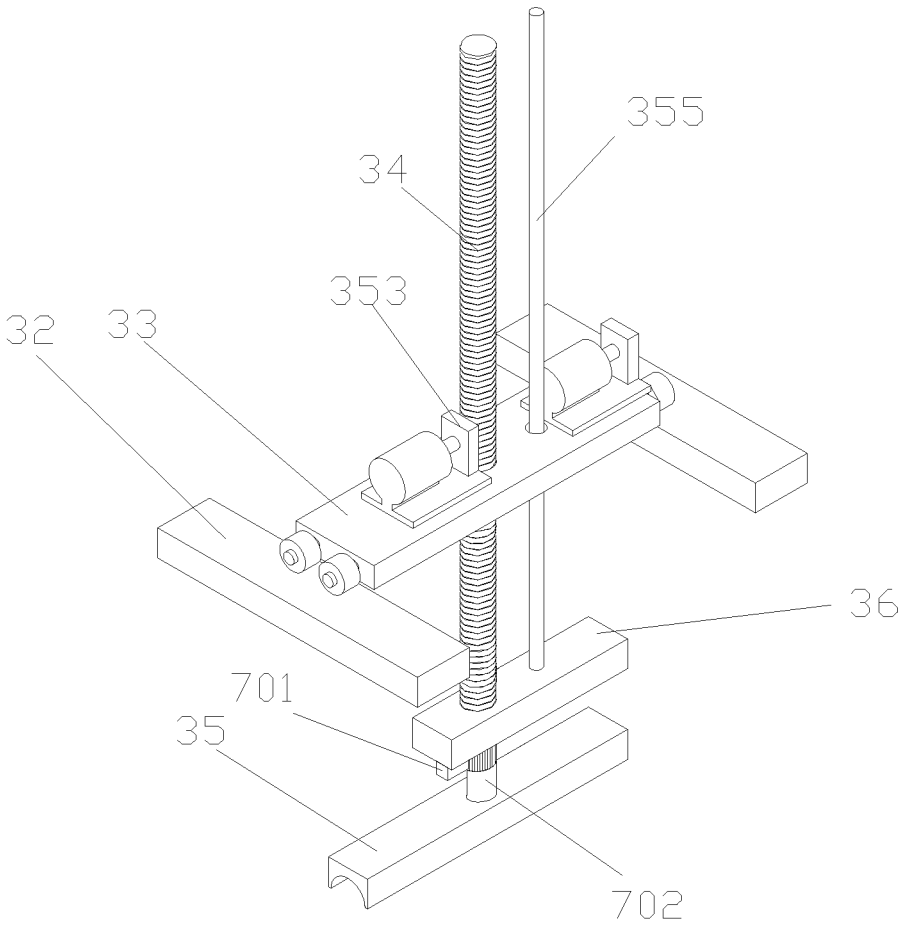
FIG. 7 schematically shows the structure of an oil pipe grasping assembly according to the first embodiment of the present disclosure.

As shown in FIGS. 1 and 7, the oil pipe grasping assembly 5 comprises two spaced-apart transverse members 32 connected between the two rail bars 61, a bearing board 33 connected between the two transverse members 32, a vertically movable rod 34 penetrating the bearing board 33 vertically, a connecting rod 702 arranged at a lower end of the vertically movable rod 34, and a clamp 35 arranged fixedly at a lower end of the connecting rod 702. The two transverse members 32 are movable along corresponding rail bars 61 (i.e., movement along the longitudinal direction) under the drive of a driving mechanism, such as an electrical motor. The bearing board 33 is movable along the two transverse members 32 (i.e., movement along the transverse direction) under the drive of a driving mechanism. The vertically movable rod 34 is movable upward and downward (i.e., movement along the vertical direction) under the drive of a driving mechanism. In this way, the clamp 35 will be movable longitudinally, transversely, and vertically. Besides, the connecting rod 702 is rotatable, and therefore can drive the clamp 35 to rotate in a horizontal plane. The vertically movable rod 34 can be a threaded rod, and a threaded member 353 corresponding to the threaded rod is provided on the bearing board 33. By controlling the movement of the clamp 35, it can be achieved that the clamp 35 (or the oil pipe grasping assembly 5) is able to grasp the oil pipe from the groove slideway 12 (or from the oil pipe delivering assembly 1) and place the oil pipe in the oil pipe bearing area 41, and grasp the positioning member 37 from the positioning member holding area 38 and place the positioning member 37 in the oil pipe bearing area 41. Thus, the device 100 for handling oil pipes is able to achieve automatic stacking of the oil pipes, thereby decreasing the work intensity of the operators, and improving the safety factors of the work. It should be noted that the driving mechanism of the vertically movable rod 34 can also be other mechanisms, such as a rack and pinion mechanism, or a chain wheel mechanism, etc., which will not be described here in detail.

If the vertically movable rod 34 is a threaded rod, the vertically movable rod 34 will be further provided thereon with a fixedly arranged anti-rotation board 36 (as shown in FIGS. 1 and 7). The anti-rotation board 36 is located above the clamp 35, and preferably, extends in a same direction as the bearing board 33 (e.g., extending in the longitudinal direction). The anti-rotation rod 355 is parallel to the vertically movable rod 34 and movably penetrates the bearing board 33, and a lower end thereof is fixedly connected to the anti-rotation board 36. When the threaded member 353 rotates, the vertically movable rod 34, when moving upward or downward, will tend to rotate due to a torque exerted thereon. In this case, the anti-rotation board 36 will transfer the torque exerted on the vertically movable rod 34 to the anti-rotation rod 355. Since the anti-rotation rod 355 is confined by the bearing board 33 and consequently cannot rotate, the vertically movable rod 34 cannot rotate but can only move upward or downward. This prevents the clamp 35 from rotating when an oil pipe is being clamped and hence prevents operators from being injured, thus increasing the safety factors of the work greatly. In addition, in the embodiment as shown in FIG. 7, an upper end of the connecting rod 702 is rotatably connected to the anti-rotation board 36, and the anti-rotation board 36 is provided thereon with a driving member 701 for driving the connecting rod 702 into rotation so as to cause the clamp 35 to rotate in the horizontal plane. It should be understood that the anti-rotation rod 355 can also be other guide mechanisms having an anti-rotation function, such as a sliding guide, a rolling guide, etc., which will not be described here in detail.

Figure 10:
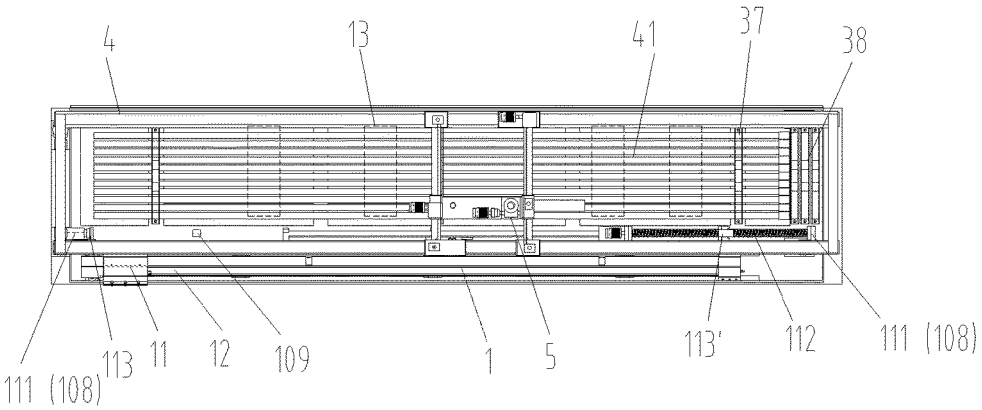
FIG. 10 is a top view of a base of the device for handling oil pipes according to the first embodiment of the present disclosure.

In order to make it easier to place the oil pipes on the groove slideway 12, preferably, the groove slideway 12 is located outside the frames 311 (or the aforementioned cuboid), and the oil pipe bearing area 41 is located inside the frames 311 (or the cuboid). In order to facilitate the grasp of the oil pipe by the oil pipe grasping assembly 5 (or the clamp 35), the groove slideway 12 is held on the base 4 by a support seat 101, and the groove slideway 12 is provided with a thrust mechanism 102 on an bottom surface thereof. The thrust mechanism 102 is connected to a driving member 107 secured on the support seat 101. An oil pipe carrying mechanism 111 adjacent and parallel to the groove slideway 12 is provided inside the frames 311 (as shown in FIG. 10). The oil pipe carrying mechanism 111 is arranged lower than the groove slideway 12. It should be understood that FIG. 10 only shows two oil pipe carrying mechanisms 111 at the two longitudinal ends of the base 4; however, a plurality of oil pipe carrying mechanisms 111 can be arranged at a clamping member guide rail 112 (which will be described below). The plurality of guide arms 105 is located on the side wall 106 of the groove slideway 12 neighboring the oil pipe carrying mechanisms 111 (see FIG. 5). When it is required to stack the oil pipes in the oil pipe bearing area 41, the oil pipe is first placed into the groove slideway 12, and then the groove slideway 12 is overturned towards the oil pipe carrying mechanism 111 by the thrust mechanism 102 and the driving member 107. In this way, the oil pipe will fall into the oil pipe carrying mechanism 111 in a steady manner under the guidance of the guide arms 105. After that, the oil pipe grasping assembly 5 moves to a position above the oil pipe carrying mechanism 111 and grasp the oil pipe. When it is required to take the oil pipe out of the oil pipe bearing area 41, the groove slideway 12 is first overturned to a position where the guide arms 105 are at the oil pipe carrying mechanisms 111, and then the oil pipe is placed into the pipe carrying mechanisms 111. When the groove slideway 12 is overturned, the oil pipe will enter into the groove slideway 12 under the guidance of the guide arms 105.

In the embodiment as shown in FIG. 10, the oil pipe carrying mechanism 111 comprises a plurality of longitudinally arranged spaced-apart carrying brackets 108, and support boards 109 arranged between neighboring carrying brackets 108. In operation, the guide arms 105 enter into gaps between neighboring carrying brackets 108.

FIG. 5 shows a first embodiment of the thrust mechanism 102. As shown in FIG. 5, the thrust mechanism 102 comprises a pair of thrust boards 501 each with a first end connected fixedly to the bottom surface of the groove slideway 12 and a second end connected to a reciprocating output shaft 502 of the driving member 107. The two thrust boards 501 are connected to each other at their middle regions through a rotary shaft 503 secured on the support seat 101, which enables the two thrust boards 501 to be able to rotate around the rotary shaft 503. In this manner, when the driving member 107, for example, a hydraulic cylinder pushes the output shaft 502 to move forward or backward, the second ends of the thrust boards 501 will accordingly move forward or backward, and the first ends of the thrust boards 501 will move to a direction (i.e., backward or forward) opposite to a direction of the second end (or the output shaft 502). Thus, the groove slideway 12, under the drive of the thrust boards 501, will be overturned or restored.

Figure 6:
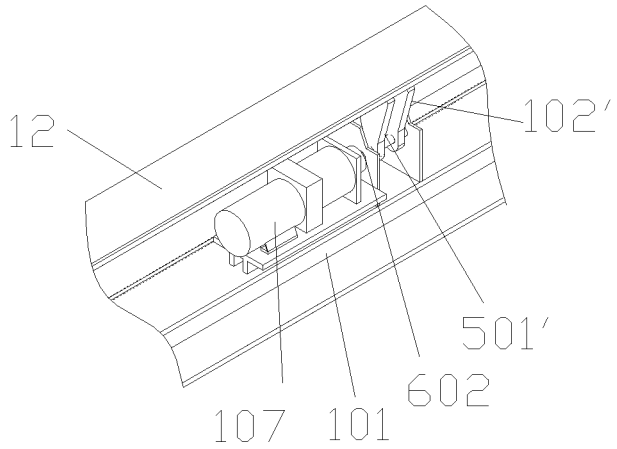
FIG. 6 schematically shows the structure of a thrust mechanism in its second embodiment according to the present disclosure.

FIG. 6 shows a first embodiment of the thrust mechanism 102'. As shown in FIG. 6, the thrust mechanism 102' comprises a pair of thrust boards 501' each with a first end connected fixedly to the bottom surface of the groove slideway 12 and a second end connected to a rotary output shaft 602 of the driving member 107. The driving member 107 can be an electrical motor. In this way, the electrical motor can drive the thrust boards 501' to rotate within a certain angular scope, thereby causing the groove slideway 12 to be overturned or restored.

In order to obtain the exact length of each oil pipe, a measuring assembly 2 for measuring the length of the oil pipe is provided at the oil pipe carrying mechanism 111. As shown in FIGS. 1 and 10, the measuring assembly 2 includes a clamping member guide rail 112 arranged below the carrying brackets 108, a clamping member 113 fixedly arranged at a longitudinal end of the base 4, a clamping member 113' movable along the clamping member guide rail 112, and a length measuring instrument 23 arranged on either of the two clamping members 113 and 113'. The clamping member guide rail 112 has a length that is about ½ of a longitudinal length of the base 4 (the length of the clamping member guide rail 112 can be shorter or longer), and the clamping member guide rail 112 extends to a longitudinal end of the base 4. In this manner, a distance between the clamping members 113 and 113' can be adjusted to adapt to oil pipes having different lengths. When the oil pipe is placed on the carrying brackets 108, the two clamping members 113 and 113' clamp two ends of the oil pipe respectively, and then the length measuring instrument 23 measures the distance between the two clamping members 113 and 113'. This distance is the length of the oil pipe. The length measuring instrument 23 can be a laser length measuring instrument, or other types of measuring instrument, which will not be described here in detail. The measuring assembly 2 for measuring the length of oil pipes is able to help to standardize the length measurement of oil pipes, thereby improving preciseness in measurement.

FIG. 2 shows the device for handling oil pipes according to a second embodiment of the present disclosure. The device 200 for handling oil pipes as shown in FIG. 2 is similar in structure to the device 100 for handling oil pipes as shown in FIG. 1. Therefore, the device 200 will be described only concerning the differences thereof as compared with the device 100.

The device 200 for handling oil pipes as shown in FIG. 2 comprises a second oil pipe rail 201 which is different from the first oil pipe rail 6 as shown in FIG. 1. The second oil pipe rail 201 is used for the oil pipe grasping assembly 210. As shown in FIG. 2, the second oil pipe rail 201 comprises a pair of spaced-apart rail bars 202 which are connected to the base 4 through respective frames 311. The spaced-apart rail bars 202 extend in the transverse direction to run across the oil pipe bearing area 41, and then reach to the oil pipe delivering assembly 1 (or the groove slideway 12). Preferably, the rail bars 202 are located above the middle part of the oil pipe bearing area 41.

The device 200 for handling oil pipes further comprises two positioning member grasping assemblies 203 and 204 each movable on a side of the second oil pipe rail 201, for grasping the positioning members respectively located at two ends of the oil pipe bearing area 41 and placing them in a corresponding positioning member holding area 38. For example, the positioning member grasping assembly 203 moves in the longitudinal direction only on the left side of the second oil pipe rail 201, and the positioning member grasping assembly 204 moves in the longitudinal direction only on the right side of the second oil pipe rail 201. For this reason, a positioning member rail 205 extending in the longitudinal direction is provided, by connection, on each side of the second oil pipe rail 201. The left part of the positioning member rail 205 is used for a first section 206 of the positioning member rail of the positioning member grasping assembly 203, and the right part of the positioning member rail 205 is used for a second section 207 of the positioning member rail of the positioning member grasping assembly 204.

It should be understood from FIG. 2 that the oil pipe grasping assembly 210 can move along the second oil pipe rail 201 to reach to an area outside the oil pipe bearing area 41 such as the groove slideway 12. Therefore, the device 200 for handling oil pipes may not comprise the oil pipe carrying mechanism 111, the thrust mechanisms 102 and 102', and the groove slideway 12 may not comprise the guide arms 105, but this is not necessarily the case. Besides, the measuring assembly 2 for measuring the length of oil pipes needs only to be arranged at the groove slideway 12.

It should also be understood from FIG. 2 that the oil pipe grasping assembly 210 needs only to be configured as such that it is movable along the transverse direction and the clamp 35 thereof is movable in the vertical direction, and that the positioning member grasping assemblies 203 and 204 need only to be configured as such that they are movable in the longitudinal direction and the clamps 35 thereof are movable in the vertical direction. Hence, the oil pipe grasping assembly 210 is the same as the positioning member grasping assemblies 203 and 204 in structure, except that the clamp 35 should be changed based on objects to be grasped.

Figure 11:
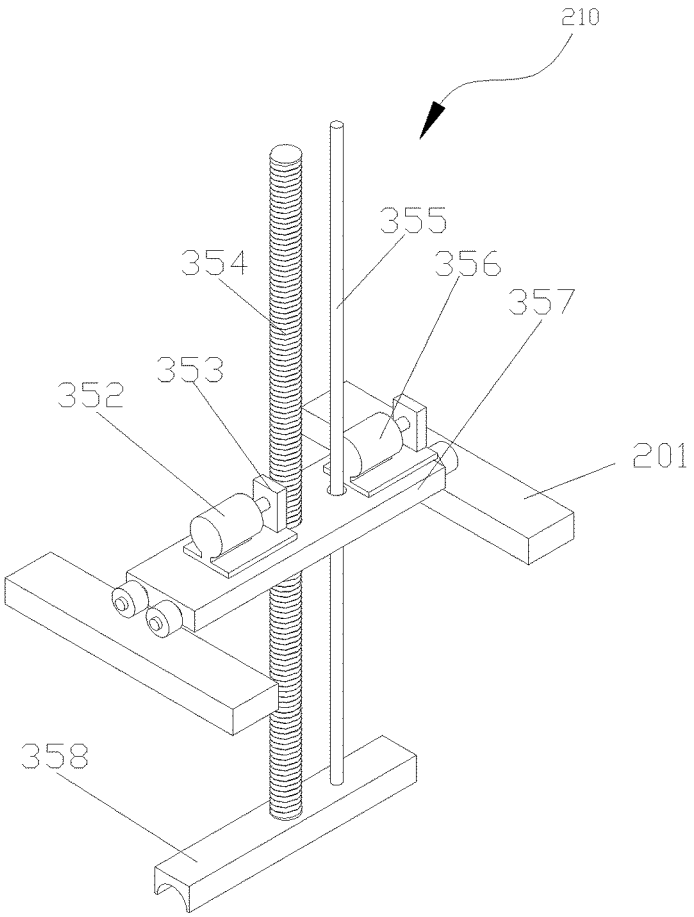
FIG. 11 schematically shows the structure of an oil pipe grasping assembly according to the second embodiment of the present disclosure.
Figure 12:
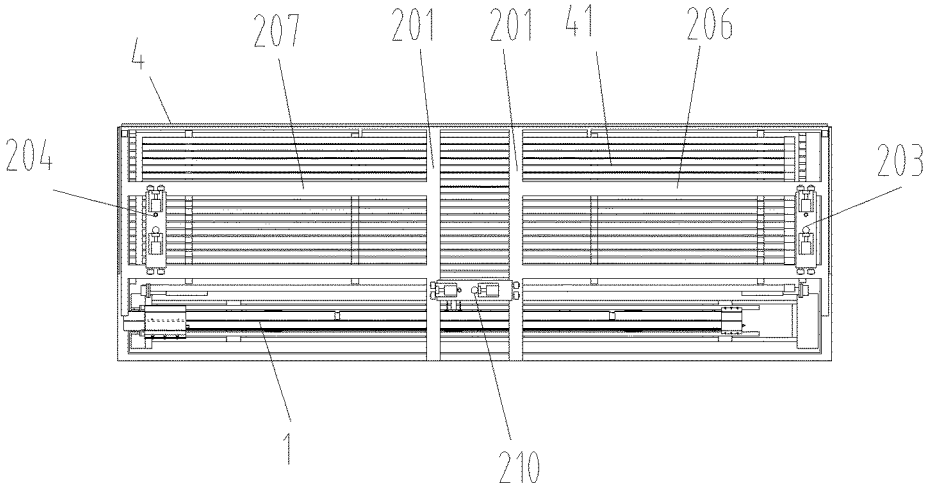
FIG. 12 is a top view of a base of the device for handling oil pipes according to the second embodiment of the present disclosure.

FIG. 11 schematically shows the structure of the oil pipe grasping assembly 210. Because the oil pipe grasping assembly 210 is simpler in movement than the oil pipe grasping assembly 5, it is simpler in structure. Specifically, the oil pipe grasping assembly 210 comprises a bearing board 357 movable along the second oil pipe rail 201, a vertically movable rod 354 penetrating the bearing board 357 vertically, and a clamp 358 arranged fixedly at a lower end of the vertically movable rod 354. The bearing board 357 moves along the second oil pipe rail 201 under the drive of an electrical motor 356 (i.e., movement along the transverse direction), and the vertically movable rod 354 moves upward and downward under the drive of an electrical motor 352 (i.e., movement along the vertical direction), which together achieve the transverse and vertical movement of the clamp 358. The vertically movable rod 354 can be a threaded rod, and a threaded member 353 corresponding to the threaded rod 354 is provided on the bearing board 357. In addition, the oil pipe grasping assembly 210 further comprises an anti-rotation rod 355 which is parallel to the vertically movable rod 354 and movably penetrates the bearing board 357. A lower end of the anti-rotation rod 355 is connected fixedly to the clamp 358. The working procedure of the oil pipe grasping assembly 210 is similar to that of the oil pipe grasping assembly 5, and therefore will not be described here in detail.

A method for workover using the device 100 or 200 for handling oil pipes provided by the present disclosure comprises the following steps.

In step 1, an oil pipe is pulled out from a well and placed in a base 4. In this procedure, if the device 100 for handling oil pipes is used, the oil pipe is first placed in the groove slideway 12, and then the groove slideway 12 is overturned to cause the oil pipe to enter into the oil pipe carrying mechanism 111, and finally, the oil pipe is carried by the oil pipe grasping assembly 5 to the oil pipe bearing area 41. If the device 200 for handling oil pipes is used, the oil pipe is first placed in the groove slideway 12, and then carried by the oil pipe grasping assembly 5 directly to the oil pipe bearing area 41.

In step 2, workover is performed.

In step 3, the oil pipe is taken out from the base 4 and run into the well. In this procedure, if the device 100 for handling oil pipes is used, the groove slideway 12 is first overturned so that the guide arms thereof are situated at the oil pipe carrying mechanism 111, and then the oil pipe is carried by the oil pipe grasping assembly 5 from the oil pipe bearing area 41 to the oil pipe carrying mechanism 111. After that, the groove slideway 12 is overturned to cause the oil pipe to enter into the groove slideway 12. Finally, the oil pipe is hoisted and then run into the well by means of a hoisting mechanism. If the device 200 for handling oil pipes is used, the oil pipe is first carried by the oil pipe grasping assembly 5 from the oil pipe bearing area 41 directly to the groove slideway 12, and is then hoisted and run into the well by means of a hoisting mechanism.

It should be noted that the workover is performed in common ways in the art, and therefore will not be described here in detail.

Preferably, in step 3, when the oil pipe is disposed on the oil pipe carrying mechanism 111 of the device 100 for handling oil pipes or on the groove slideway 12 of the device 200 for handling oil pipes, the measuring assembly 2 can be used to measure the length of the oil pipe, and then the oil pipe is run into the well. In this way, a length of multiple oil pipes connected to each other in the well can be measured exactly, which will facilitate subsequent work.

The present disclosure has been described with reference to the above preferred embodiments, but without departing from the spirit and scope of the present disclosure, anyone skilled in the art can make any amendments to the present disclosure and substitute the components described herein with any equivalents. In particular, as long as there is no structural conflict, any of the technical features in any of the embodiments may be combined with one another, and the technical solutions obtained therefrom all fall within the scope of the present disclosure.

The invention claimed is:

1. A device for handling oil pipes, comprising:

a base which comprises an oil pipe bearing area extending in a longitudinal direction, the oil pipe bearing area being provided therein with at least one positioning member arranged in a transverse direction perpendicular to the longitudinal direction of the base, for positioning an oil pipe, and a movable oil pipe grasping assembly, which is located above the base, and is configured to grasp the oil pipe and place the oil pipe in the oil pipe bearing area, or grasp the oil pipe from the oil pipe bearing area and place the oil pipe in an area outside the oil pipe bearing area, wherein the base further comprises a positioning member holding area adjacent to an end of the oil pipe bearing area, and the positioning, member holding area contains a plurality of positioning members which are operable to be arranged in the oil pipe bearing area for stacking multiple layers of oil pipes, and wherein the positioning member comprises a long and narrow body, a plurality of grooves formed on an upper surface of the body for positioning the oil pipe therein, and a connecting structure formed at both ends of the body, wherein the connecting structure comprises a receiving groove with an upward opening, and a bolt extending downwards, the bolt having an extending length larger than a depth of the receiving groove.

2. The device according to claim 1, wherein the base further comprises an oil pipe delivering assembly arranged on a lateral side of the base and parallel to the oil pipe hearing area, and the device is configured as such that the oil pipe is first placed longitudinally in the oil pipe delivering assembly and then placed, by the oil pipe grasping assembly, in the oil pipe bearing area, or, that the oil pipe is grasped from the oil pipe bearing area and placed longitudinally in the oil pipe delivering assembly by the oil pipe grasping assembly.

3. The device according to claim 2, wherein the oil pipe delivering assembly comprises a groove slideway arranged fixedly on the base in the longitudinal direction, the groove slideway being provided therein with an oil pipe pulley, and the oil pipe pulley is configured as such that an free end of the oil pipe in a vertical state is accommodated in the oil pipe pulley, and the oil pipe can slide along the groove slideway under the drive of the oil pipe pulley until the oil pipe is contained longitudinally in the groove slideway.

4. The device according to claim 3, wherein the oil pipe delivering assembly further comprises a support seat for holding the groove slideway on the base, and an oil pipe carrying mechanism arranged longitudinally between the groove slideway and the oil pipe bearing area, the oil pipe carrying mechanism being arranged lower than the groove slideway, and the groove slideway is provided with a thrust mechanism on an bottom surface thereof, the thrust mechanism being connected to a driving member secured on the support seat, so that the groove slideway can be overturned to cause the oil pipe to enter into the oil pipe carrying mechanism.

5. The device according to claim 4, wherein the oil pipe carrying mechanism comprises a plurality of longitudinally arranged spaced-apart carrying brackets, and support boards arranged between neighboring carrying brackets.

6. The device according to claim 4, wherein a first oil pipe rail for the oil pipe grasping assembly is provided above the base, the first oil pipe rail being configured to extend in the longitudinal direction to run across the oil pipe bearing area and the positioning member holding area, and connect the base through a frame, and the oil pipe bearing area and the oil pipe carrying mechanism are located inside the frame, and the groove slideway is located outside the frame.

7. The device according to claim 6, wherein the first oil pipe rail comprises two spaced-apart parallel rail bars, and the oil pipe grasping assembly comprises two spaced-apart transverse members movably connected between the two rail bars, a bearing board movably connected between the two transverse members, a vertically movable rod penetrating the bearing board vertically, a connecting rod arranged at a lower end of the vertically movable rod, and a clamp arranged at a lower end of the connecting rod and rotatable in a horizontal plane.

8. The device according to claim 7, wherein the oil pipe grasping assembly further comprises an anti-rotation board secured at the lower end of the vertically movable rod, and an anti-rotation rod which is parallel to the vertically movable rod and movably penetrates the bearing board, the anti-rotation rod being connected fixedly to the anti-rotation board at a lower end thereof, and the connecting rod is rotatably connected to the anti-rotation board at an upper end thereof, and the anti-rotation board is provided thereon with a driving member for driving, the connecting rod into rotation so as to cause the clamp to rotate in the horizontal plane.

9. The device according to claim 2, further comprising a second oil pipe rail arranged above the base for the oil pipe grasping assembly, wherein the second oil pipe rail is configured to extend in the transverse direction to run across the oil pipe bearing area and reach to the oil pipe delivering assembly, and connect the base through a frame.

10. The device according to claim 9, wherein the base comprises two positioning member holding areas which are adjacent to two ends of the oil pipe bearing area respectively, the device comprises a positioning member grasping assembly arranged above the base, and a positioning member rail arranged above the base for the positioning member grasping assembly, the positioning member rail comprises a first section of the positioning member rail and a second section of the positioning member rail, which are configured to extend in the longitudinal direction to run across a corresponding positioning member holding area, and are connected to two sides of the second oil pipe rail respectively, and the positioning member rail is connected to the base through the frame, and two positioning member grasping assemblies for two positioning member holding areas respectively are arranged in the first section of the positioning member rail and the second section of the positioning member rail respectively.

11. The device according to claim 9, wherein the oil pipe grasping assembly or the positioning member grasping assembly comprises a bearing board movable along a rail, a vertically movable rod penetrating the bearing board vertically, and a clamp secured at a lower end of the vertically movable rod.

12. The device according to claim 11, wherein the oil pipe grasping assembly further comprises an anti-rotation rod parallel to the vertically movable rod and movably penetrating the bearing board, the anti-rotation rod being connected fixedly to the clamp at a lower end thereof.

13. The device according to claim 7, wherein the vertically movable rod is a threaded rod, and an internally threaded member associated with the threaded rod is provided on the bearing board.

14. The device according to claim 5, further comprising a measuring assembly for measuring length of the oil pipe, the measuring assembly including two clamping members for clamping two ends of the oil pipe, and a length measuring instrument arranged on either of the two clamping members.

15. The device according to claim 14, wherein the measuring assembly further comprises a clamping member guide rail longitudinally arranged below the plurality of carrying brackets, and one of the two clamping members is fixed, and the other is movable along, the clamping member guide rail under the drive of a driving member.

16. The device according to claim 1, wherein the oil pipe bearing area is provided therein with a plurality of spaced-apart sockets which are arranged in multiple lines along the longitudinal direction, and the positioning member comprises a plurality of straight rods each vertically insertable into a respective one of the plurality of sockets.

17. The device according to claim 4, wherein the thrust mechanism comprises a thrust hoard with a first end connected fixedly to the bottom surface of the groove slideway and a second end connected to a rotary output shaft of the driving member.

18. The device according to claim 4, wherein the thrust mechanism comprises a thrust board, and a rotary shaft movably penetrating a central area of the thrust board, the thrust board being connected fixedly to the bottom surface of the groove slideway at a first end thereof and connected to a reciprocating output shaft, of the driving member at a second end thereof, the rotary shaft being secured on the support seat.

19. The device according to claim 4, wherein the groove slideway is provided with a plurality of guide arms on a side wall thereof adjacent to the oil pipe carrying mechanism, the plurality of guide arms extending along a direction of the side wall.

* * * * *